US009593549B2

(12) United States Patent
McClinton et al.

(10) Patent No.: US 9,593,549 B2
(45) Date of Patent: Mar. 14, 2017

(54) SEGMENTED LOCKING RING FOR A WELLHEAD

(71) Applicant: McClinton Energy Group LLC, Odessa, TX (US)

(72) Inventors: Tony McClinton, Odessa, TX (US); Jeremy Perkins, Odessa, TX (US)

(73) Assignee: McClinton Energy Group LLC, Odessa, TX (US)

( * ) Notice: Subject to any disclaimer, the term of this patent is extended or adjusted under 35 U.S.C. 154(b) by 369 days.

(21) Appl. No.: 14/162,389

(22) Filed: Jan. 23, 2014

(65) Prior Publication Data

US 2015/0204154 A1 Jul. 23, 2015

(51) Int. Cl.
*E21B 33/04* (2006.01)
*E21B 33/03* (2006.01)
*E21B 17/08* (2006.01)

(52) U.S. Cl.
CPC ..... *E21B 33/03* (2013.01); *E21B 17/08* (2013.01); *E21B 33/04* (2013.01)

(58) Field of Classification Search
CPC ..... E21B 33/04
USPC ..... 166/96.1, 75.14
See application file for complete search history.

(56) References Cited

U.S. PATENT DOCUMENTS 3,155,401 A * 11/1964 Musolf ..... E21B 33/04 166/344
3,297,344 A * 1/1967 Hanes ..... E21B 33/038 285/123.9
4,552,213 A * 11/1985 Boyd ..... E21B 33/047 166/375
5,149,143 A * 9/1992 Howell ..... F16L 23/04 285/18
5,327,972 A * 7/1994 Theiss ..... E21B 33/04 166/208
5,490,565 A * 2/1996 Baker ..... E21B 33/03 166/379
6,920,925 B2 * 7/2005 Duhn ..... E21B 33/068 166/379
7,416,020 B2 * 8/2008 Duhn ..... E21B 33/03 166/75.13
7,441,594 B2 * 10/2008 Vanderford ..... E21B 33/04 166/368
8,272,433 B2 * 9/2012 Duhn ..... E21B 33/03 166/75.13
8,403,057 B2 * 3/2013 Rodgers ..... E21B 33/038 166/338

* cited by examiner

*Primary Examiner* — Kenneth L Thompson
(74) *Attorney, Agent, or Firm* — Seyfarth Shaw LLP; Brian Michaelis

(57) ABSTRACT

The present disclosure is directed to a locking assembly to attach a quickset casing head of a wellhead assembly to a landing mandrel attached to a surface casing in a drilling operation. A locking ring, comprised of a plurality of arcuate segments, is arranged between the quickset casing head and the landing mandrel. Each of the plurality of arcuate segments is clamped down onto the landing mandrel with a plurality of radially spaced lockdown bolts fastened through the quickset casing head. The clamping enables a seal between the quickset casing head and the landing mandrel without requiring arduous welding.

23 Claims, 9 Drawing Sheets

SEGMENTED LOCKING RING FOR A WELLHEAD

BACKGROUND OF THE INVENTION

The present disclosure generally relates to systems and methods for preparing an oil or gas well. More specifically, the present disclosure relates to systems and methods for attaching and securing a wellhead to the surface casing for use in a drilling or work over operation.

A wellhead assembly includes several components of drilling machinery which must be sealingly attached to a terminal end of the surface casing extending into a drilled well. Due to the vertical height of the fully assembled wellhead, the surface casing is typically terminated at a distance several feet below the surface of the Earth within a constructed cellar. By creating a cellar and terminating the surface casing within the cellar, controls on the highest components of the wellhead assembly are accessible from the surface for operation of the well.

The wellhead attachment to the surface casing must be capable of withstanding pressures of at least 0 to 10,000 psi. Traditionally, this attachment has been achieved by welding the wellhead to a landing mandrel attached to the terminal end of the surface casing within the cellar. This welding task is complex due to the tight quarters of the cellar, the size of the wellhead assembly and the time required to sealingly weld the entire circumference of the landing mandrel. As a result, the current method of connecting the wellhead assembly to the landing mandrel consumes additional labor and resources, and necessitates the use of the drilling rig to support the wellhead assembly in place during welding, rather than freeing the drilling rig for other necessary drilling preparation tasks.

Therefore, a need exists for a cost- and time-effective way to properly and sealingly attach the wellhead assembly to the landing mandrel of the surface casing without monopolizing use of the drilling rig during the valuable well-preparation period.

SUMMARY OF THE INVENTION

The present disclosure includes an improved method and device for connecting a wellhead assembly to a surface casing without the requirement of welding or the monopolization of the drilling rig during a lengthy connection process. Included in the base portion of the wellhead assembly is a quick set casing. A landing mandrel is connected to a terminal end of the last joint of the surface casing. The quick set casing includes specifically milled geometry to mate with the landing mandrel. The landing mandrel also includes specifically milled geometry such that, when the quick set casing and the landing mandrel mate, a series of seals and a locking ring are configured to suitably and sealingly connect the quick set casing (and therefore the wellhead assembly) to the landing mandrel (and therefore the surface casing). By using a locking ring comprised of a plurality of locking ring segments, the wellhead assembly need only be lowered onto the landing mandrel, and a sealing connection is achieved by energizing a plurality of radially spaced bolts. The bolts create a sufficient connection when tightened to brace the quick set casing with the bolt and the individual locking ring segments against the landing mandrel on the end of the bolt. By employing the disclosed device and method, connecting the wellhead assembly to the surface casing is significantly simplified resulting in decreased labor, cost, time, and resources required.

Additional features and advantages of the present invention are described in, and will be apparent from, the following Detailed Description of the Invention and the Figures.

DETAILED DESCRIPTION OF THE INVENTION

Preparing an oil or gas well to access a hydrocarbon formation generally requires the steps of: drilling a hole, installing a conductor pipe in the hole, cementing a surface casing substantially concentrically within the conductor pipe, attaching a wellhead assembly to the surface casing, and completing the drilling process to the required depth of the hydrocarbon formation. One of ordinary skill in the art would understand that the general procedure for drilling and preparing a well can be accomplished in any number of ways.

Regardless of how the well is prepared, all wells require the wellhead assembly to be sealingly attached to a pipe that extends into the ground. Typically, this sealing connection between the wellhead assembly and the pipe is accomplished by means of an extensive circumferential weld between the bottom of the wellhead assembly and the terminal end or connector end of the pipe. In some cases, one or more welds are required to ensure a sealed connection. One of ordinary skill in the art will appreciate that the task of suitably welding the wellhead assembly to the pipe requires a burdensome use of labor, time, money and other resources. In addition to the welding labor and time, the drilling rig must also be occupied during the entire procedure to support the wellhead assembly during the welding process.

Figure 1:
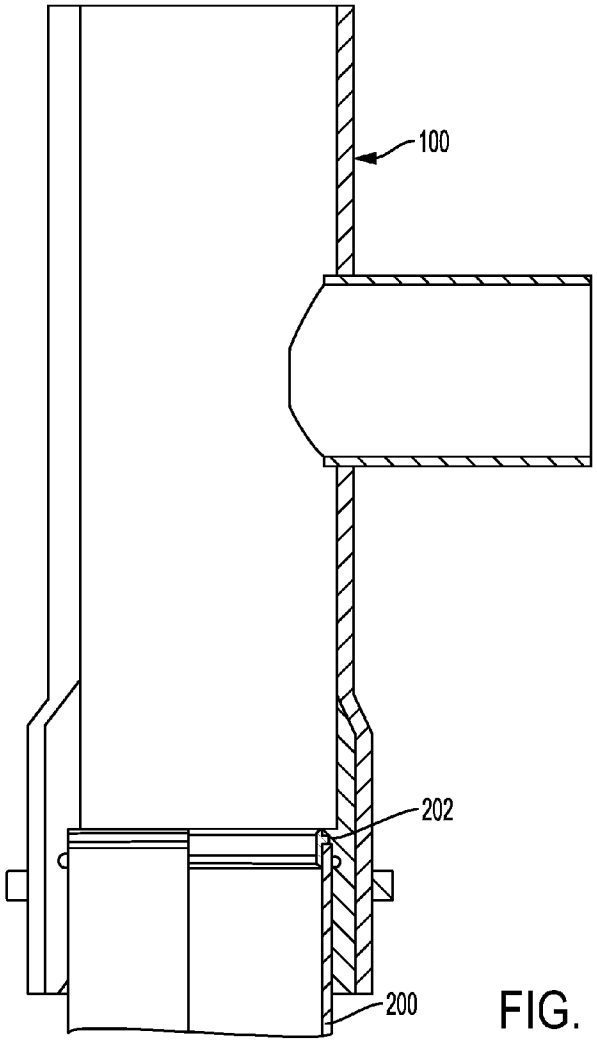
FIG. 1 illustrates a partial cross-section of one embodiment of a conductor pipe and diverter system of the present invention.

Referring now to FIG. 1, a conductor pipe 200, its terminal end, and a diverter system 100 are illustrated. Upon drilling an initial hole, an outer pipe or conductor pipe 200 is installed into the ground. For purposes of this disclosure, the outer pipe is referred to as the conductor pipe, but one of ordinary skill in the art will appreciate that such a well component may be referenced as several different names, including but not limited to starter casing, conductor casing, and pilot casing. The name used herein is exemplary and not limiting.

Although not illustrated, in most instances, the initial hole is drilled starting at the bottom of a cellar or pit excavated and reinforced from the surface level. In certain embodiments, the cellar is dug to a depth of between two and ten feet. The depth of the cellar largely depends upon the fully assembled height of the wellhead assembly when installed, and is not limited to the two to ten foot range. After installation of the conductor pipe 200, and considering the fully assembled height of the wellhead assembly, the conductor pipe 200 is measured and cut for installation of support ring 202. For purposes of this disclosure, the ring welded onto the end of the conductor pipe is referred to as the support ring, but one of ordinary skill in the art will appreciate that such a well component may be referenced as several different names, including but not limited to starter ring and load ring. The name used herein is exemplary and not limiting. In various embodiments, the attachment of the support ring 202 onto the cut end of the conductor pipe 200 is accomplished prior to moving in the drilling rig (not illustrated) so as to save time and resources.

Figure 2:
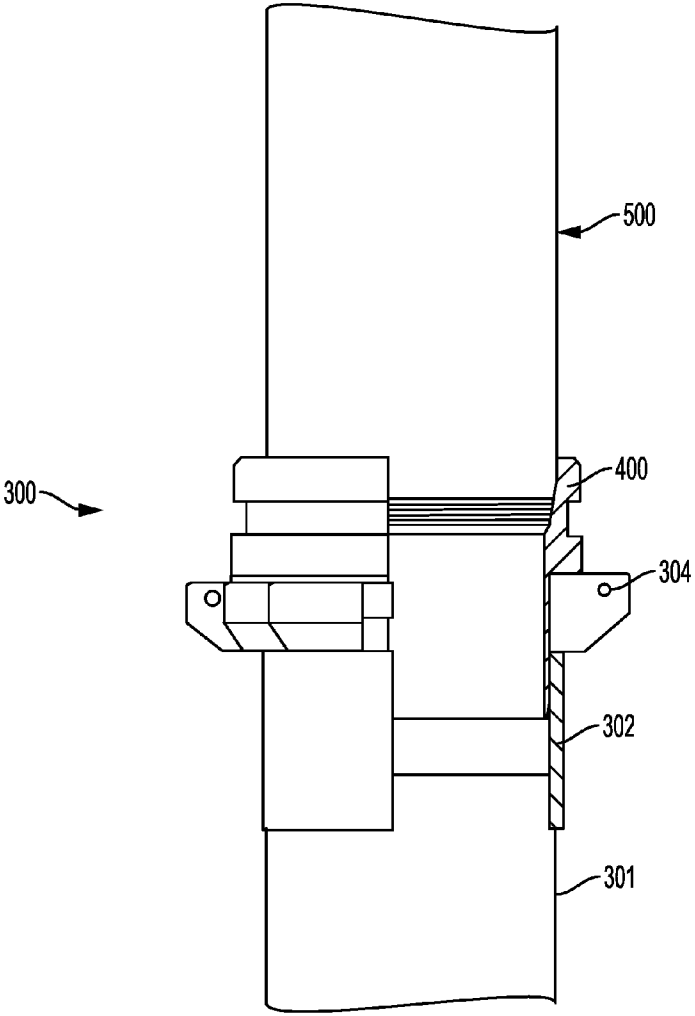
FIG. 2 illustrates a partial cross-section of one embodiment of a surface casing assembly of the present invention.
Figure 3:
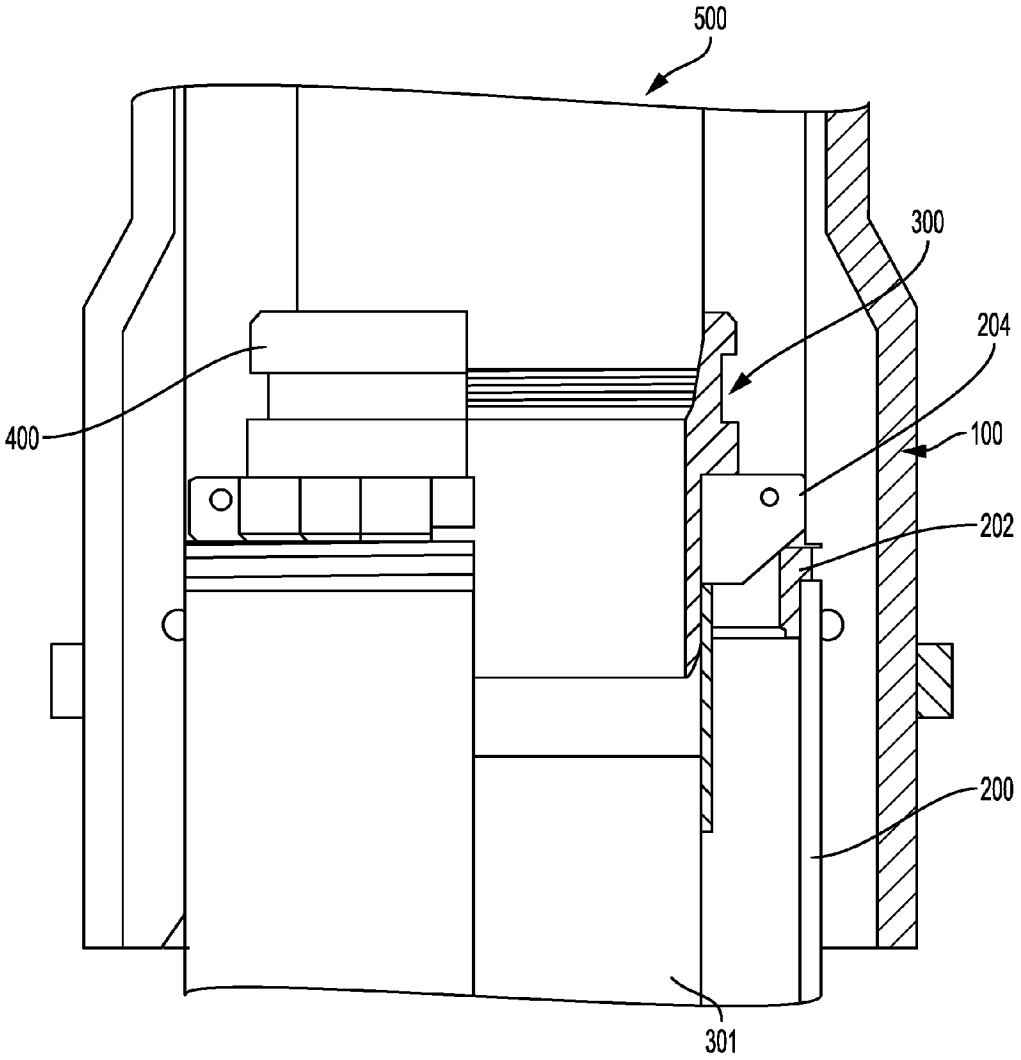
FIG. 3 illustrates a partial cross-section of one embodiment of a surface casing assembly assembled with a conductor pipe of the present invention.

Following the sizing of the conductor pipe 200 and the attachment of the support ring 202, a diverter system 100 is installed to control flow to the mud pit or mud holding tank while drilling out and cementing the surface casing 301 (See FIGS. 2 and 3). The surface casing 301 is part of a surface casing assembly 300, which includes several components to aid in accurate installation within the conductor pipe 200.

Referring now to FIG. 2, a partial cross section of a surface casing assembly 300 of one embodiment is illustrated and described. In one embodiment, a landing mandrel 400 is attached to the terminal end of the surface casing 301 by way of a suitable connection and a casing collar 302. For the purposes of this disclosure, the connector attached to the end of the surface casing is referred to as the landing mandrel, but one of ordinary skill in the art will appreciate that such a well component may be referenced as several different names, including but not limited to connector, casing hanger, casing mandrel, crossover mandrel, fluted mandrel, and/or threaded hanger. The name used herein is exemplary and not limiting.

Figure 7:
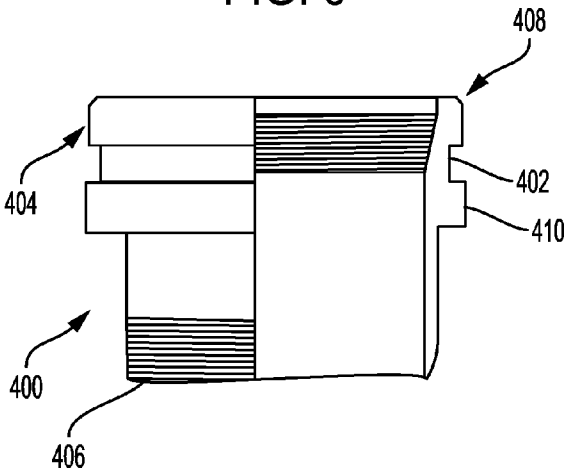
FIG. 7 illustrates a partial cross section of one embodiment of a landing mandrel of the present invention.

Referring briefly to FIG. 7, the landing mandrel 400 is illustrated, disassembled. Outer circumferential threads 406 at the base portion of the landing mandrel 400 are configured to mate with threads milled into the inner portion of casing collar 302 (FIG. 2). In one embodiment, the landing ring 304 is secured between the landing mandrel 400 and the casing collar 302. In various embodiments, the landing mandrel 400 is referred to as a connector attached to a well pipe or surface casing.

In the illustrated embodiment, the landing ring 304 is fluted or includes a lower bevel around its periphery. As illustrated in FIG. 3, the bevel or fluted feature of landing ring 304 is designed to mate with the support ring 202 of the conductor pipe 200 when the surface casing assembly 300 is inserted into the conductor pipe 200. By beveling the landing ring 304, the surface casing assembly 300 centers itself within the conductor pipe 200 when installed. In various embodiments, a top edge of the landing ring 304 can also serve as a base plate for a wellhead assembly, discussed and illustrated in more detail below.

It should be appreciated that, by centering the surface casing assembly 300 within the conductor pipe 200, a uniform concrete barrier can be poured between the surface casing 301 and the conductor pipe 200 to ensure safety and fluid tightness in the well. A landing joint 500 is threaded into the top portion of the landing mandrel 400 to accomplish the pumping of concrete into the surface casing 301 and eventually up between the outer circumferential wall of the surface casing 301 and the inner circumferential wall of the conductor pipe 200. It should be appreciated that connecting the various components to one another can occur in any suitable order. Additionally, one of ordinary skill in the art will appreciate that different components can be attached to the surface casing 300 to accomplish the same task of centering the surface casing 300 within the conductor pipe 200 and ensuring an accurate installation of the surface casing 300 in the well.

Figure 4:
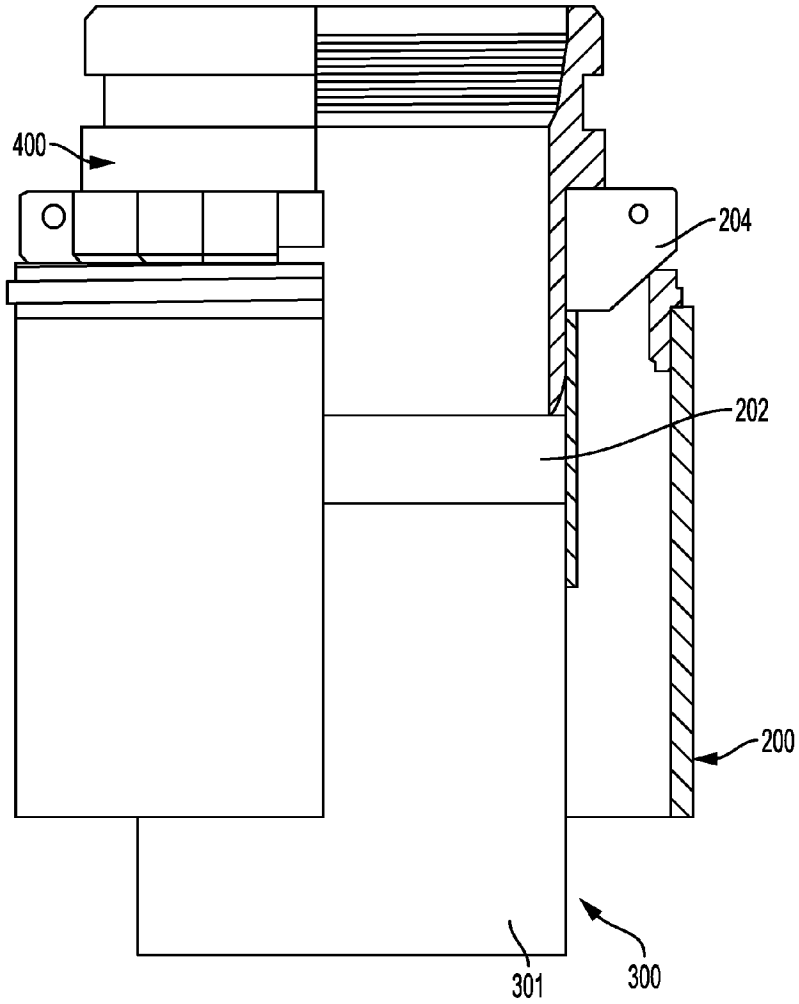
FIG. 4 illustrates a partial cross-section of one embodiment of a surface casing assembly assembled with a conductor pipe of the present invention.

Referring now to FIGS. 3 and 4, the surface casing assembly 300 installed within the conductor pipe 200 is illustrated. As discussed above and illustrated in FIG. 3, surface casing assembly 300 includes landing mandrel 400, which is threadingly attached to casing collar 302. The landing ring 204 sits on top of support ring 202 of the conductor pipe 200. Diverter system 100 is installed over both the surface casing 300, the conductor pipe 200 and the landing joint 500 to divert drilling debris and fluid into the mud pit or mud tank during the drilling and cementing process. After the surface casing assembly 300 is centered, installed and cemented within the conductor pipe 200, the landing joint 500 is disengaged from the landing mandrel 400, and the diverter system 100 removed, leaving the conductor pipe 200 and the surface casing assembly 300 with a secure terminal connection in the form of the landing mandrel 400, as illustrated in FIG. 4.

At this point in the well preparation process, the wellhead assembly (or partial wellhead assembly 600) is prepared for attachment onto the surface casing assembly 300 and conductor pipe 200. It should be appreciated that, although several different wellhead components can be included in a wellhead assembly, only those that directly interact with the connection between the surface casing assembly 300 and the wellhead assembly 600 are discussed in detail herein. Depending upon the type of drilling operation, some or all of the components of the wellhead assembly 600 can be pre-assembled before attachment to the surface casing assembly 300 inside of the cellar.

Figure 5:
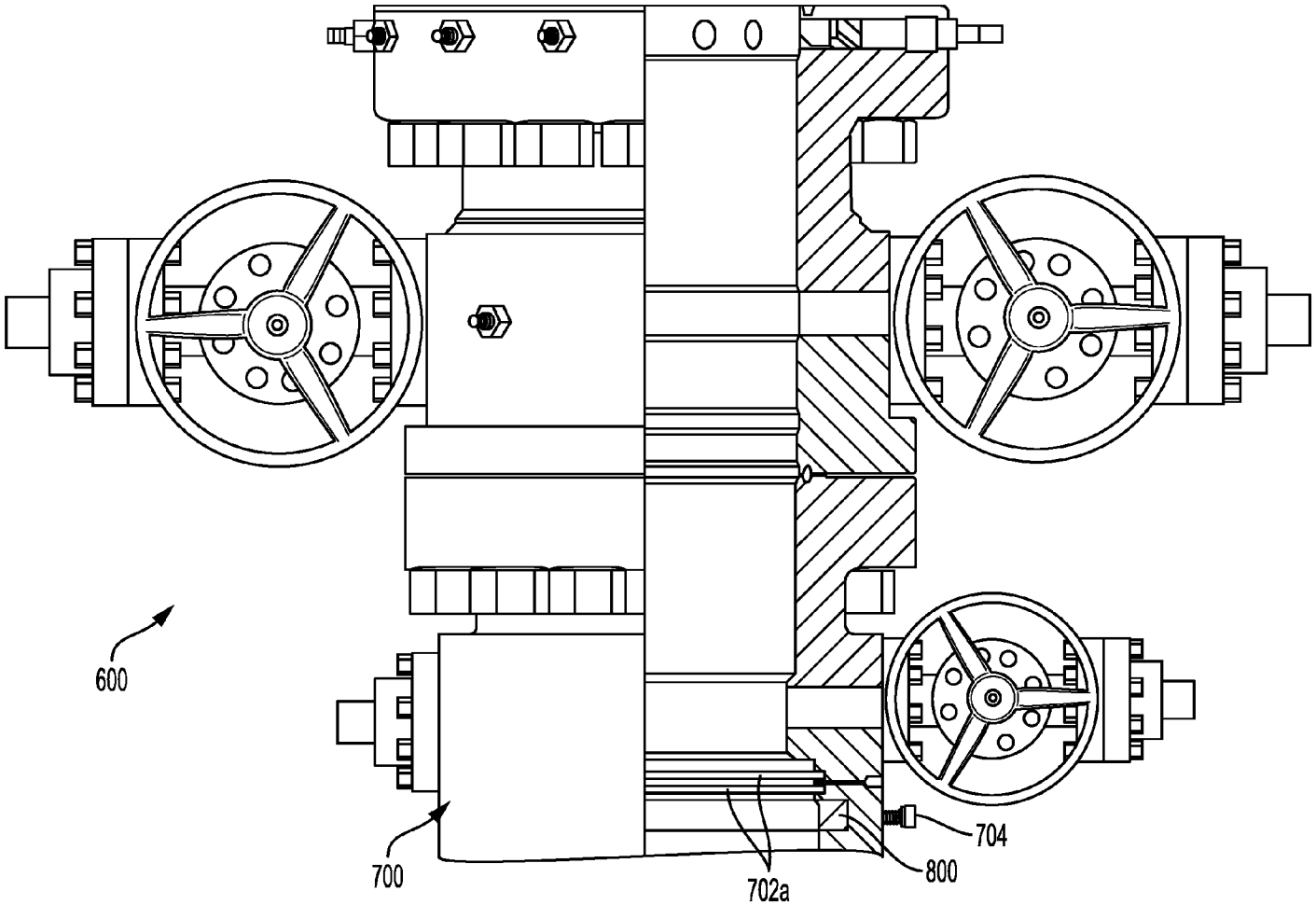
FIG. 5 illustrates a partial cross-section of one embodiment of a partial wellhead assembly of the present invention.

Referring now to FIG. 5, a partial wellhead assembly 600 of one embodiment of the present disclosure is illustrated. Included in the partial wellhead assembly 600 is a quickset casing head 700 configured to attach on one end to additional wellhead components, and on the other end to mate with the landing mandrel 400 of surface casing assembly 300. For purposes of this disclosure, the lower most component of the wellhead assembly 600 is referred to as the quickset casing head, but one of ordinary skill in the art will appreciate that such a well component may be referenced as several different names, including but not limited to locking ring head and casing head. In other embodiments, this component can also be referred to, without limiting its function in the present disclosure, other common names in the art such as "A" section, braiding head, starter head, thread on head, and/or weld on head. The name used herein is exemplary and not limiting.

Figure 6:
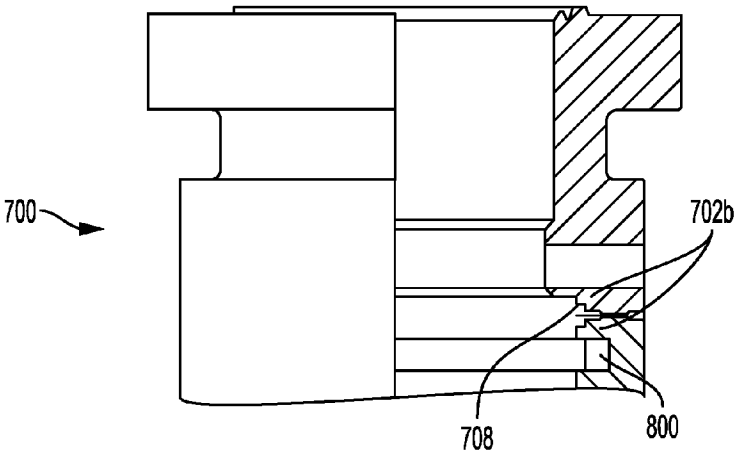
FIG. 6 illustrates a partial cross-section of one embodiment of a quickset casing head of the present invention.
Figure 9:
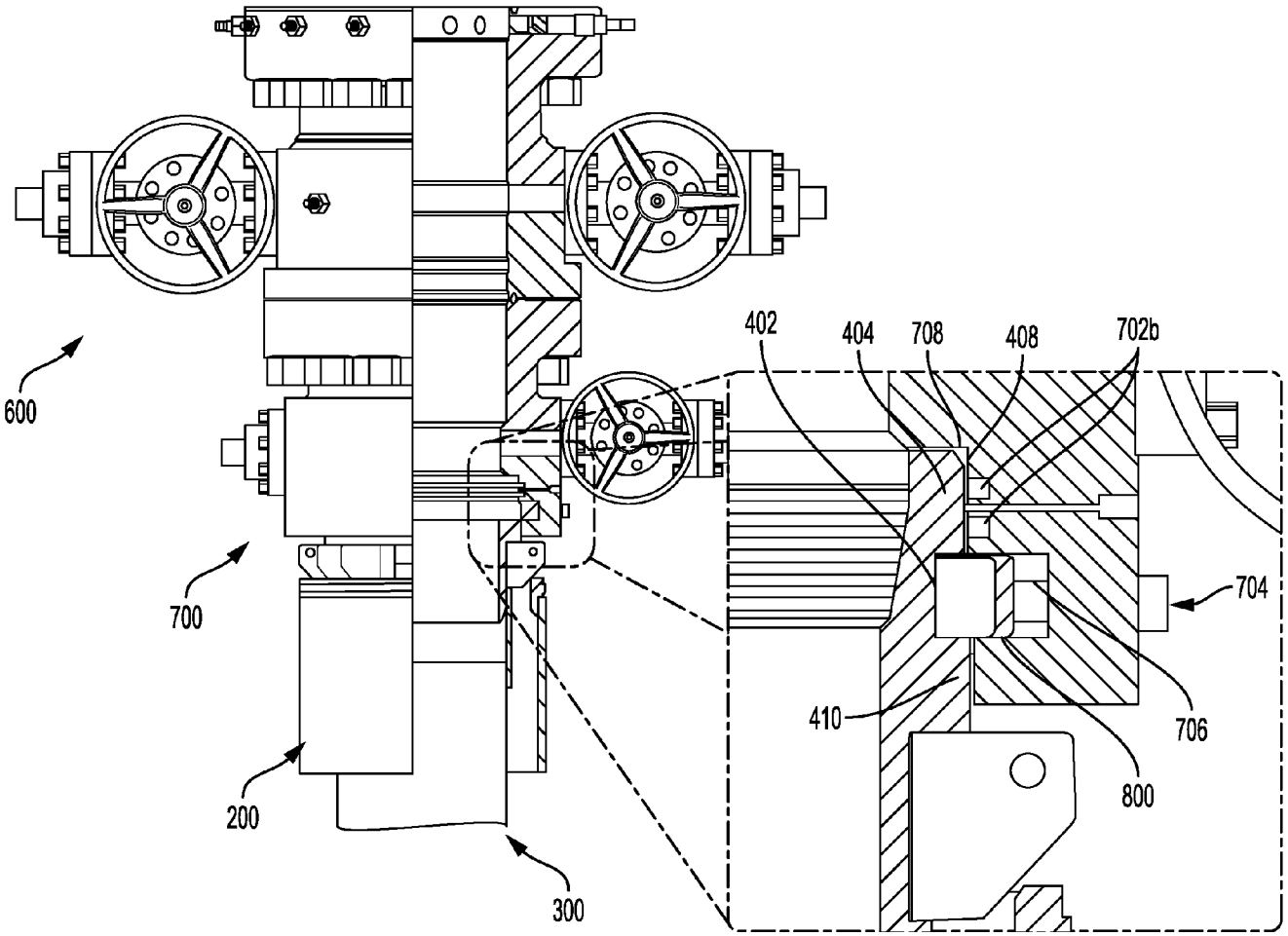
FIG. 9 illustrates a partial cross section and detail of one embodiment of an assembly including a partial wellhead assembly, a surface casing assembly, and a conductor pipe of the present invention.

The quickset casing head 700 is illustrated disassembled from the partial wellhead assembly 600 in FIGS. 5, 6 and 9. The quickset casing head 700 of one embodiment of the present disclosure includes a plurality of milled features which enable a sealed, suitable connection with the landing mandrel 400. Circumferential grooves 702*b* milled into the inner wall of the quickset casing head 700 are configured to receive gaskets or seals 702*a* (FIG. 5). The quickset casing head 700 also includes a plurality of radially spaced lockdown bolt holes (not shown in the illustrated cross section) which receive lockdown bolts 704 (FIGS. 5, 9). The lockdown bolt holes are spaced radially around the quickset casing head 700 and are configured to extend from the outer circumferential surface through the quickset casing head wall and into inner circumferential groove 706 (FIG. 9). The quickset casing head 700 also includes several additional features understood by those of ordinary skill in the art, but not discussed in detail herein.

Referring now to FIG. 7 and FIG. 9 in detail, a partial cross-sectional view of a landing mandrel 400 of one embodiment of the present disclosure is illustrated. The landing mandrel 400 includes outer threads 406, which suitably mate with the casing collar 302 attached to the surface casing 301, thereby securing the landing ring 304 between the casing collar 302 and the landing mandrel 400. The landing mandrel 400 also includes lower and upper circumferential flanges 410 and 404 respectively. When assembled with the landing ring 304, the bottom part of lower flange 410 braces the top portion of landing ring 304 (see FIG. 9). Groove 402 of landing mandrel 400 is the area defined between upper flange 404 and lower flange 410.

In an assembled configuration of one embodiment, landing mandrel 400 is inserted into the quickset casing head 700. Specifically, when assembled, the groove 402 of the landing mandrel 400 aligns with corresponding groove 706 (see FIG. 9 detail) of the quickset casing head 700. Additionally, edge 408 of the landing mandrel 400 abuts inner circumferential edge 708 of the quickset casing head 700. It should be appreciated that, when seals 702*a* are installed into grooves 702*b* of the quickset casing head, the seals 702*a* function to press radially inwardly against upper circumferential flange 404 of the landing mandrel 400 to maintain a pressure-tested fluid tight barrier between the quickset casing head 700 and the landing mandrel 400.

Figure 8:
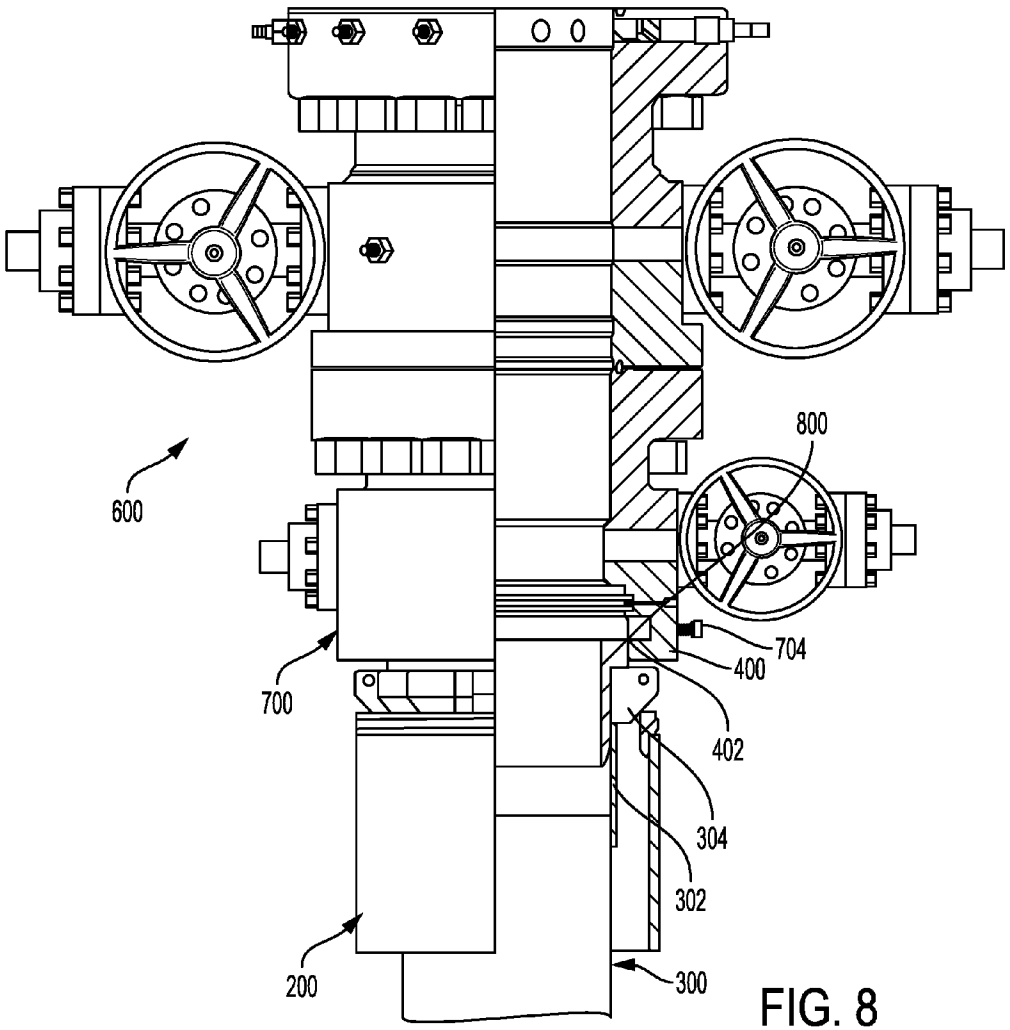
FIG. 8 illustrates a partial cross section of one embodiment of an assembly including a partial wellhead assembly, a surface casing assembly, and a conductor pipe of the present invention.

As discussed above, current methods of attaching a casing head to a landing mandrel require extensive welding in at least one circumferential location. Referring to FIGS. 8 and 9, one embodiment of the present disclosure illustrates an alternative to the strictly welding connection used in the prior art. FIG. 8 illustrates the partial wellhead assembly 600 mounted on top of landing mandrel 400, which is already connected to the surface casing assembly 300 within the cellar and cemented to the conductor pipe 200, as discussed above.

Prior to lowering the partial wellhead assembly 600 onto the landing mandrel 400, a segmented locking ring 800 (FIGS. 10 and 11) is installed within groove 706 of the quickset casing head 700. It should be appreciated that for the present disclosure and discussion, the quickset casing head 700, landing mandrel 400 and segmented locking ring 800 are referred to, collectively, as the locking assembly.

Figure 10:
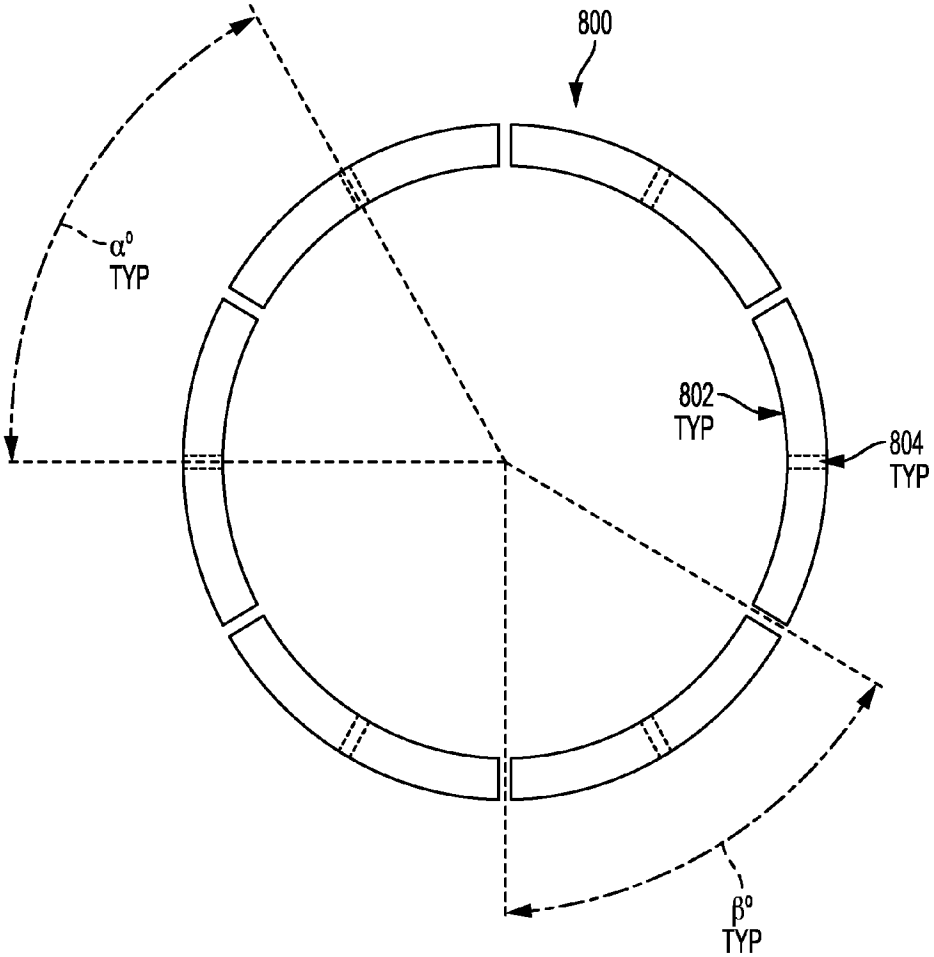
FIG. 10 illustrates a front facing schematic view of one embodiment of a locking ring of the present invention.

As seen in FIG. 10, the segmented ring 800 includes a plurality of equal-sized arc-shaped segments 802 which, when assembled together, form a substantially 360-degree ring. Depending upon the size of the landing mandrel 400 needed for the job and the size/working pressure of the quickset casing head needed for the job, the locking ring 800 may be segmented into ten segments, but should not be limited to ten segments. In the illustrated embodiment, the segmented locking ring 800 includes six segments 802. It should be appreciated that in various embodiments, the number of equally sized segments can vary from two segments to ten segments, depending upon the size and working pressure needed. Each segment 802 defines a radially oriented lockout hole 804 bored through to accept a lockout bolt (not pictured). It should be appreciated that in various embodiments, lockout hole 804 is threaded. In some embodiments, the lockout hole 804 is bored completely through the width $\lambda$ of the segment 802, and in other embodiments the lockout hole 804 is only bored partially radially inwardly from the outer tangential surface of the segment 802.

In the illustrated embodiment, arc angle $\alpha$=60° and arc angle $\beta$=60°. In the embodiment in which arc angle $\alpha$=60° and arc angle $\beta$=60°, it should be appreciated that the spacing of the lockdown bolt holes on the quickset casing head 700 is also 60°. One of ordinary skill in the art would understand that it is necessary to match the lockout hole 804 with the lockdown bolt holes on the quickset casing head 700. Therefore, in various embodiments, the radial displacement of the lockout holes 804 in the segments 802 of the locking ring 800 matches the radial displacement of the lockdown bolt holes in the casing head 700. In one embodiment, the number of equal-sized rings used determines a same arc angle $\beta$ according to the equation: $\beta°=360°\pm X$, where X=the number of equally sized segments used.

It should also be appreciated that in various un-illustrated embodiments, the arc-shaped ring segments need not be the same size as one another, as in the illustrated embodiment. In such alternative embodiments, arc angles $\alpha$ and $\beta$ may vary from one ring segment to the next. Similar to evenly-dimensioned ring segments, for varying sized ring segments, the lockdown holes of the quickset casing head will be radially spaced according to the spacing of the lockout holes on the ring segments. In various embodiments, it should also be appreciated that arc angle $\alpha$ is not equal to arc angle $\beta$, even if each of the segments includes the same arc angle $\beta$. In such embodiments, one of ordinary skill in the art will appreciate that one or more lockout bolts is required to engage a respective lockout hole 804 to retain a single segment 802 within the quickset casing head 700. Similarly, one of ordinary skill in the art would appreciate that some embodiments require the use of more than one lockdown bolt 704 per segment 802.

To install the segmented locking ring 800 into groove 706 of the quickset casing head 700, a lockout bolt (not shown) is first inserted through each of the radially spaced lockdown bolt holes and threaded into the lockout hole 804. The function of the lockout bolt is to draw each segment 802 to the circumferentially outermost wall of groove 706 to provide clearance for the locking mandrel 400 to pass fully into the quickset casing head 700. It should be appreciated that in some embodiments, the lockout bolt is smaller in diameter than the lockdown bolt 704, and is therefore allowed to pass through the lockdown bolt hole without being threaded. In alternative embodiments, the retaining ring 800 is held by a different suitable retaining mechanism than the lockout bolt system described herein.

When the partial wellhead assembly 600 is fully lowered onto the landing mandrel 400 by the drilling rig, the grooves 402 and 706 are aligned, and the segmented locking ring 800 remains retained within groove 706. The seals 702*a* within grooves 702*b* of the quickset casing head can provide pressure sealing strength rated from 0 to 10,000 psi. The pressure sealing strength depends upon the seals needed for the job set by the size and working pressure of the well. In various embodiments, the seals are tested for the working pressure of the quickset casing head and the test pressure can be held for at least ten minutes or more. In some embodiments, the seals 702*a* are tested after the partial wellhead assembly 600 is seated on the landing mandrel 300, but before the quickset casing head 700 secures the partial wellhead assembly 600 to the landing mandrel 300. In various embodiments, the seal test occurs after the secure connection has been made.

The lockout bolts are then removed, and lockdown bolts 704 are threaded through the lockdown bolt holes of the quickset head casing 700. The lockdown bolts thread through the quickset head casing outer wall and into groove 706, and are configured to push radially inwardly against each of the segments 802 of the segmented locking ring 800. As seen in FIG. 9, the lockdown bolts 704 are energized and push segments 802 of segmented locking ring 800 radially into groove 402, thereby clamping the quickset casing head 700 to the landing mandrel 400.

Figure 11:
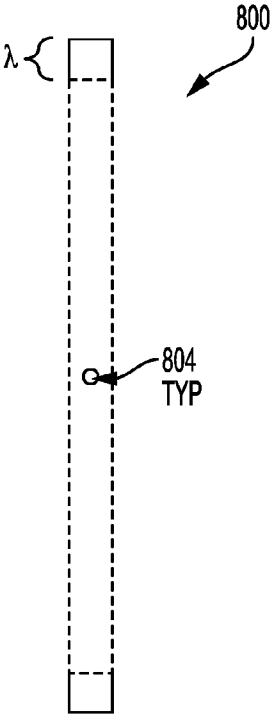
FIG. 11 illustrates a side facing schematic view of one embodiment of a locking ring of the present invention.

It should be appreciated that, as seen in FIGS. 9 and 11, segmented locking ring 800 includes a width λ that is thicker than the radial depth of groove 402 of the landing mandrel 400, but not as thick as the radial depth of groove 706 of the quickset head casing 700. Dimensioning the segmented locking ring 800 in such a fashion enables each segment 802 to be fully retracted within groove 706 prior to the wellhead assembly 600 being lowered onto the landing mandrel 400 (shown in FIG. 8). The dimensioning also ensures that, when the lockdown bolts 704 are energized against the segments 802 of the segmented locking ring 800, that the segmented locking ring 800 will occupy all of groove 402 of the landing mandrel 400 as well as part of groove 706 of the quickset casing head 700 (shown in FIG. 9 detail). The segmented locking ring 800 overlapping both grooves 402 and 706 provides an additional secure connection preventing the axial separation of the quickset casing head 700 (and therefore the wellhead assembly) from the landing mandrel 400 (and therefore the surface casing assembly 300 and conductor pipe 200). From an axial cross-sectional perspective, the individual locking ring segments 802, when all lockdown bolts 704 are fully tightened, converge together to create a substantially complete 360° degree ring. In various embodiments, it should be appreciated that small gaps may remain between the segments 802 even after the lockdown bolts 704 are fully tightened.

In one present embodiment, the lockout hole 804 of segment 802 is configured to engage a smaller-diameter lockout bolt, but remains too small to engage the larger-diameter lockdown bolt 704. This tolerancing is designed so that a lockdown bolt 704 applies pressure radially inwardly against each entire locking ring segment 802 rather than threading through lockout hole 804 and applying more concentrated pressure from the bolt directly onto the landing mandrel 400. By applying pressure across the larger arcuate surface area of the segment 802 onto the circumference of the landing mandrel 400 in groove 402, the quickset casing head 700 evenly and reliably retains the landing mandrel 400. Alternatively, if lockdown bolts 704 are tightened directly onto the landing mandrel 400 in groove 402 without a locking ring segment 802 to evenly distribute the force across a larger surface area, the connection would result in undesirable concentration of force on the landing mandrel 400 at each lockdown bolt. Such inconsistent force concentration could result in bolts failing before the high pressure capacity required of the connection is achieved.

With the locking system described in the present disclosure, a task that previously required significant labor and several hours is reduced to a task that can be accomplished by one worker energizing the lockdown bolts 704 in less than 30 minutes. In some embodiments, the task can be accomplished by one worker in 22 minutes or less. In addition to enabling a quick and reliable sealed connection between the wellhead assembly 600 and the surface casing assembly 300, the present disclosure allows for quick and easy disconnection of the same. Rather than requiring a torch cutter, saw or other means of removing a welded joint, one must merely unbolt the lockdown bolts 704, insert the lockout bolts to retract the locking ring segments 802 into groove 706, and hoist the wellhead assembly using the drilling rig or winch. It should be appreciated that such ease of maneuverability is desirable to ensure that valves and pipes of the wellhead assembly can be rearranged efficiently as circumstances require by rotating the wellhead assembly. In addition to saving the drilling operator in welding and cutting labor cost, time, and use of the drilling rig for support, the present system also obviates a safety hazard present in previous methods of connection. Due to the relatively small space defined by a typical cellar, the task of welding a wellhead assembly in place onto an installed landing mandrel includes working in cramped quarters increasing the chance for injury, accident or welding error.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A locking assembly, comprising:

a casing head including an inner circumferential groove located in an inner wall of the casing head:

a connector attached to a well pipe extending into the ground, the connector including an outer circumferential groove located in an outer wall of the connector, the outer circumferential groove defined by an upper flange and a lower flange, wherein the upper and lower flanges have opposing parallel surfaces: and a segmented locking ring comprised of a plurality of arcuate segments, each of the of arcuate segments being installed in the inner circumferential groove of the casing head, each of the arcuate segments including an upper side and a lower side, the upper side of each of the arcuate segments mating with the upper flange of the outer circumferential groove of the connector and the lower side of each of the arcuate segments mating with the lower flange of the outer circumferential groove of the connector when the segmented locking ring is coupled to the connector.

2. The locking assembly of claim 1, wherein the connector is a landing mandrel.

3. The locking assembly of claim 1, wherein the well pipe is a surface casing.

4. The locking assembly of claim 1, wherein the casing head is attached to a wellhead assembly to be mounted for a hydrocarbon drilling operation.

5. The locking assembly of claim 1, wherein the segmented locking ring includes a number of arcuate segments selected from the group consisting of 2, 3, 4, 5, 6, 7, 8, 9, and 10.

6. The locking assembly of claim 5, wherein a first of the arcuate segments has an arc angle that is not equal to that of a second of the arcuate segments.

7. The locking assembly of claim 5, wherein each of the arcuate segments has an equal arc angle.

8. The locking assembly of claim 7, wherein the equal arc angle is equal to 360°÷X, where X equals a quantity of the arcuate segments.

9. The locking assembly of claim 1, wherein the outer circumferential groove of the connector includes a circumferential groove wall defining a periphery of the connector and having a circumferential groove wall diameter.

10. The locking assembly of claim 9, wherein coupling of the segment locking ring to the connector includes coupling the arcuate segments against the circumferential groove wall of the connector.

11. The locking assembly of claim 10, wherein each of the arcuate segments has an inner arcuate segment wall that follows a segment diameter.

12. The locking assembly of claim 11, wherein the segment diameter is substantially equal to the circumferential groove wall diameter of the connector.

13. The locking assembly of claim 1, wherein the inner circumferential groove of the casing head includes an inner circumferential groove wall defining an inner diameter of the casing head.

14. A method of locking a casing head to a connector of a well pipe comprising:

installing arcuate segments of a segmented locking ring into an inner circumferential channel of a casing head;

fitting the casing head and the segmented locking ring over the connector to substantially align the inner circumferential channel of the casing head with an outer circumferential channel of the connector; and clamping, by imparting a force radially inwardly, each arcuate segment of the segmented locking ring into the outer circumferential channel of the connector so an upper side of each arcuate segment mates with an upper flange of the outer circumferential channel of the connector and a lower side of each arcuate segment mates with a lower flange of the outer circumferential channel of the connector, wherein the upper and lower flanges have opposing parallel surfaces.

15. The method of claim 14, wherein the arcuate segments each have a radial thickness causing the arcuate segments to at least partially reside within both the outer circumferential channel of the connector and the inner circumferential channel of the casing head when the arcuate segments are clamped into the outer circumferential channel of the connector.

16. The method of claim 14, wherein the force imparted radially inwardly is effectuated by energizing at least one lockdown bolt through at least one respective lockdown bolt hole defined in the casing head.

17. The method of claim 14, wherein each of the arcuate segments includes at least one retaining bolt hole extending radially through at least a portion of an outer circumferential wall of the respective arcuate segment.

18. The method of claim 17, wherein each of the arcuate segments is installed within the inner circumferential channel of the casing head by inserting a retaining bolt through the casing head and threadingly into the retaining bolt hole of each of the respective arcuate segments.

19. The method of claim 18, wherein the retaining bolt retains each of the arcuate segments within the inner circumferential channel of the casing head prior to fitting the casing head over the connector.

20. The method of claim 19, wherein the outer circumferential wall of each arcuate segment is held against the inner circumferential channel of the casing head with each respective retaining bolt.

21. The method of claim 16, wherein the at least one lockdown bolt is configured to threadingly engage the at least one respective lockdown bolt hole.

22. The method of claim 21, wherein the lockdown bolt threaded through the lockdown bolt hole and imparts the force radially inwardly against the segment.

23. The method of claim 16, wherein each arcuate segment is clamped into the outer circumferential channel of the connector by energizing two or more lockdown bolts that each impart a force radially inward.

* * * * *